United States Patent [19]

Compton

[11] Patent Number: 4,822,119

[45] Date of Patent: Apr. 18, 1989

[54] LATERAL FILING CABINET WITH ROTARY DRAWERS

[76] Inventor: Arthur M. Compton, 33 Library St. NE, Grand Rapids, Mich. 49503

[21] Appl. No.: 119,545

[22] Filed: Nov. 12, 1987

[51] Int. Cl.[4] ..... A47B 88/00

[52] U.S. Cl. ..... 312/328; 312/326

[58] Field of Search ..... 312/326, 327, 325, 328, 312/329, 275, 276

[56] References Cited

U.S. PATENT DOCUMENTS 4,616,891 10/1986 Jantzen ..... 312/328

FOREIGN PATENT DOCUMENTS 10755 4/1907 Denmark ..... 312/328

811614 6/1951 Fed. Rep. of Germany ..... 312/325

*Primary Examiner*—Joseph Falk

*Attorney, Agent, or Firm*—Robert K. Wallor

[57] ABSTRACT

A lateral file construction which includes a stationary case open on one side and one or more drawers in the form of elongated open top boxes. The drawers are pivotally mounted to the case on trasverse axes parallel to the long side of the drawer as viewed from above. The drawers are opened and closed by rotating about said axes. The drawers may be interconnected by linkage or other means such that some or all of them open and close simultaneously.

4 Claims, 2 Drawing Sheets

LATERAL FILING CABINET WITH ROTARY DRAWERS

SUMMARY OF INVENTION

This invention relates to improvements in the design of office furniture commonly known as "lateral files". Lateral files may be described as generally similar to the "chest of drawers" or "bureau" to be found in most domestic bedrooms. They consist of a "case" open on one side, into which are inserted one or more drawers mounted on "slides" which permit them to move horizontally in and out relative to the case.

Lateral files are used for the storage and retrieval of business papers and documents as well as discs and other hardware and software related to the computer field. In common with chest of drawers, and as distinguished from "vertical files", (another office accessory used for the same purpose as lateral files), the motion of a conventional lateral file drawer in opening and closing is parallel to the short dimension of the drawer, as viewed from above.

Further, in order to prevent instability during use, the conventional lateral file incorporates an "interlock" mechanism which permits only one drawer to open at a time, and also often incorporates rear mounted ballast in the form of steel plates or other weighty substance.

Lateral files may have only one or as many as five or six drawers located one above another.

Conventional lateral files have the following disadvantages:

1. If a drawer is pulled open too vigorously, or if two or more drawers open at one time, the entire assembly may tip over toward the user, causing injury to the user.
2. Since the interlock mechanism usually permits only one drawer to open at a time, that drawer must be closed before another can be opened. Hence searching through the file for a given document or article can be a slow process.
3. Since even one open drawer interferes with movement of personnel in the area immediately in front of the file, the file must be placed at a distance from other stationary objects, thus wasting floor space.
4. Conventional drawer slides are of uncertain service life, and can cause drawers to stick shut or partially open. The user may then tug on the stuck drawer, causing the entire assembly to tip over toward the user.
5. Since the contents of the drawers in a conventional lateral file can be seen only from above, a short person must use a stool when working with the upper drawers.

DRAWINGS

Two sheets of drawings are attached and form a part of this application. The figures are described as follows.

DETAILED DESCRIPTION

Figure 1:
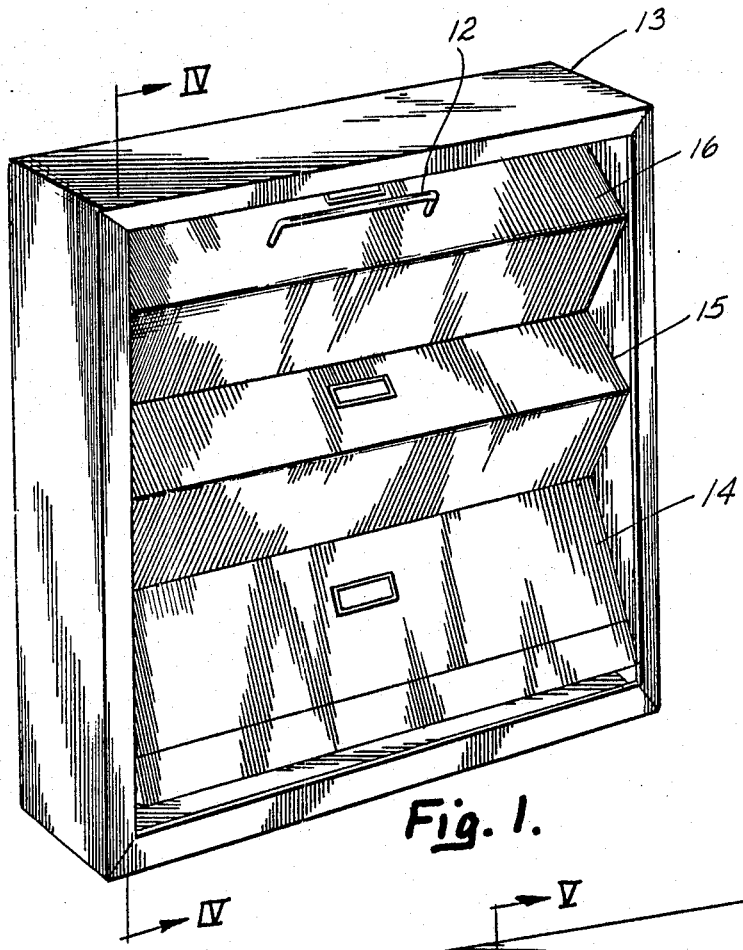
FIG. 1 shows the file in the closed condition.

The instant invention is similar to a chest of drawers and to a conventional file in that it comprises a stationary case 13, open on one side, and one or more drawers disposed as shown on the attached drawings. The lowest drawer 14 is pivotted about transverse axis 10, FIG. 4 and 5, located below the centroid of the drawer as seen in the side view. The remaining drawers 15, 16, etc. are pivotted about transverse axes 11, FIGS. 4 and 5, located approximately at the centroid of those drawers as seen in the side view.

Figure 2:
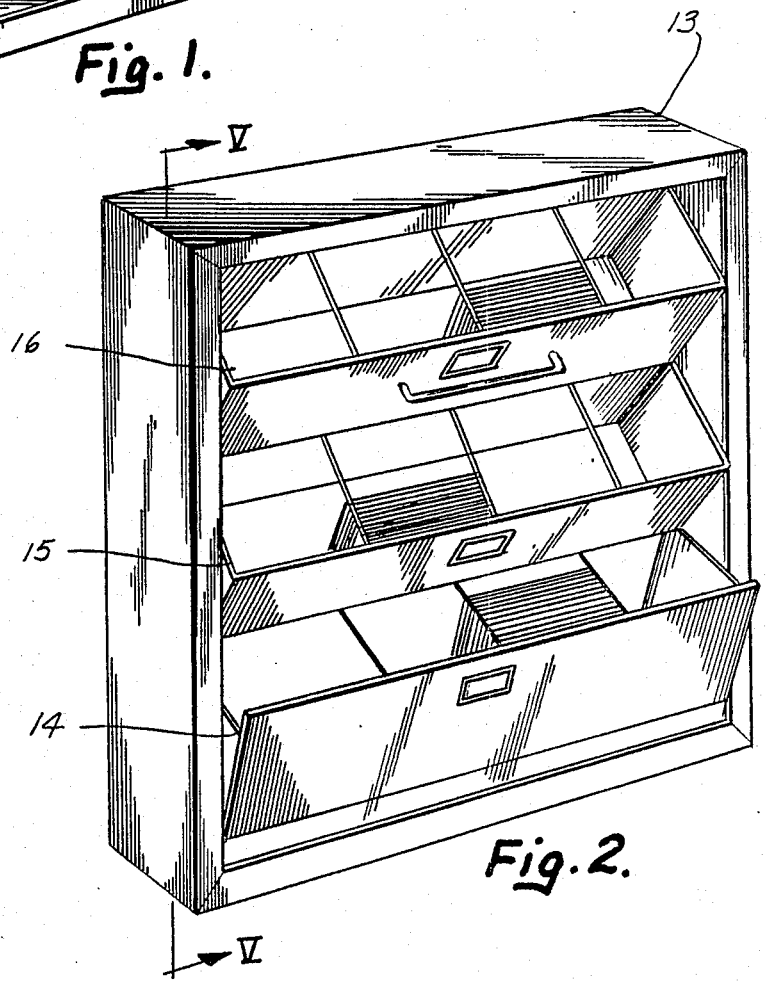
FIG. 2 shows the file in the open condition, with filed material visible in each of the three drawers.
Figure 3:
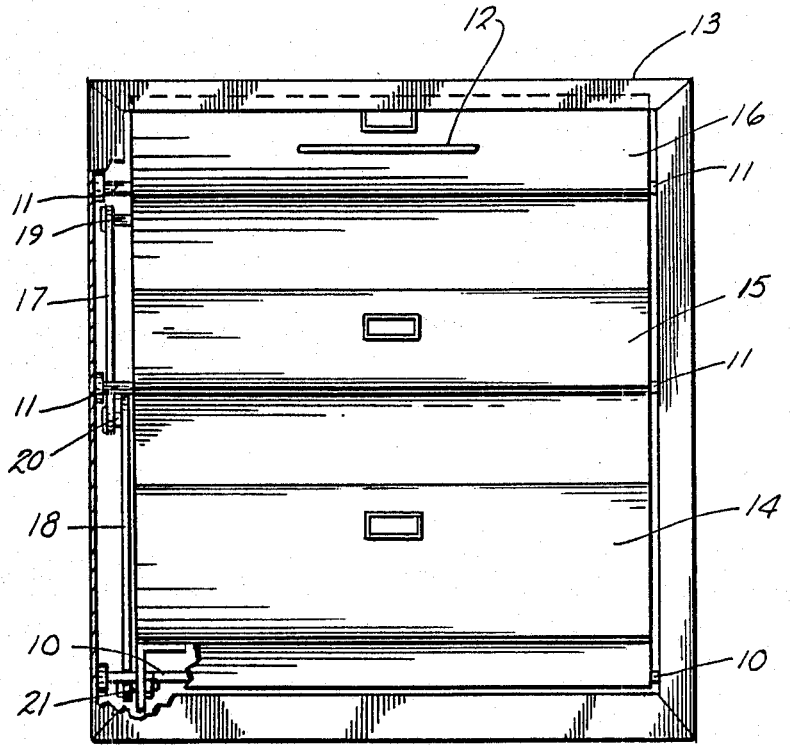
FIG. 3 is a front view of the file in the closed condition, with the case partially cut away to show the drawer interconnecting linkage.
Figure 4:
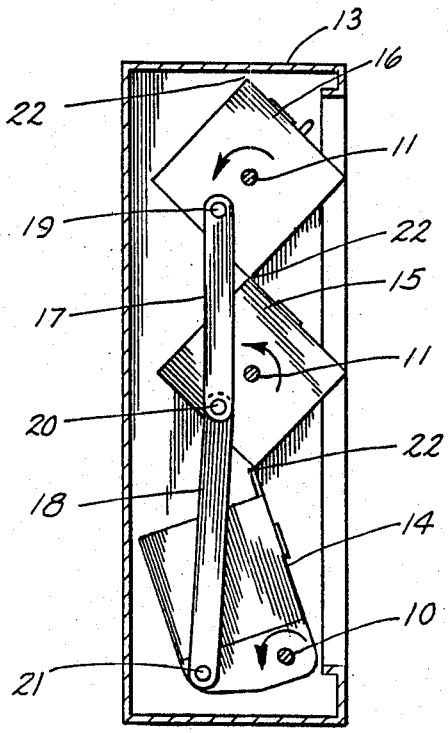
FIG. 4 is a side view of the closed file with the near side removed to disclose another view of the drawer interconnecting linkage and its relationship to the drawers and to the drawer pivotting axes.

Drawer 16 is equipped with a bar handle 12, FIG. 3, or any other easily grasped handle, by means of which the drawer may be rotated counter-clockwise into its closed position in FIG. 4 as shown by the curved arrows in that figure. Similarly, referring now to FIG. 5, by using the same handle drawer 16 may be rotated clockwise into its open position, thereby exposing its contents, as may be seen in FIG. 2. Alternatively, the handle may be incorporated on any or all of the drawers, as convenience may dictate.

Figure 5:
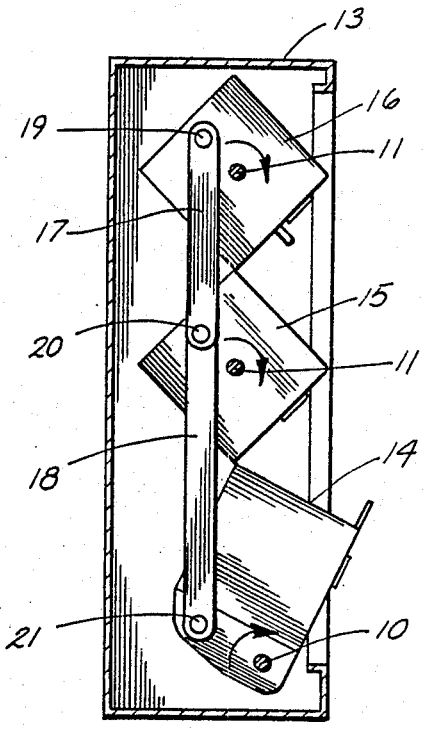
FIG. 5 is identical to FIG. 4 except that it shows the drawers in the open condition.

Referring to figures 4 and 5, it will be seen that drawer 16, which in this case incorporates the handle, is connected to drawer 15 by means of link 17. Similarly, drawer 15 is connected to drawer 14 by means of link 18. The links are pivottaly connected to the respective drawers at points 19, 20, and 21.

An object of this invention is to provide a type of lateral file which is more convenient to use because all drawers are opened at once, exposing the entire contents of the file for quick perusal. This feature permits rapid retrieval, which saves time and money.

Another object of the invention is to provide a type of lateral file that is safer to use since it remains stable and therefore unlikely to tip over even with all drawers open. (In contrast, the conventional lateral file becomes "tippy" when one loaded drawer is fully opened, and will usually tip over on the user if two or more loaded drawers are fully opened.)

Another object of the invention is to provide a type of lateral file that saves office space since the drawers do not protrude significantly from the case when open.

Another object of the invention is to provide a type of lateral file which is safer and more convenient to use since it exposes its contents in such a way that a short person can view the contents of the upper drawers without the use of a stool or similar object.

Another object of the invention is to provide a type of lateral file that saves manufacturing cost because no drawer interlock mechanism is needed.

Another object of the invention is to provide a type of lateral file that saves manufacturing and shipping cost because no ballast is required for stability.

Another object of the invention is to provide a type of lateral file that saves manufacturing cost because no anti-rebound or parallel motion mechanisms are needed.

Having thus described my invention and its objectives, I claim:

1. A lateral file construction comprising:

a stationary case having a bottom wall, a top wall, a rear wall, a pair of opposed side walls, and a substantially open front, said case further forming a generally rectangular parallelopiped having a height, a width from side wall to side wall, and a depth from front to rear;

a plurality of drawers, each in the form of an elongated rectangular parallelopiped having an open top, a pair of opposed end walls, a bottom wall, a front wall, and a rear wall, each of said drawers further having a height, a length, and a depth;

means for pivotally supporting each of said drawers between each of said opposed end walls and the respectively adjacent opposed side walls of said case such that said plurality of drawers are disposed in a generally vertical spaced array, the length of each drawer extending within the width of the case, at least one of said means for pivotally supporting said drawers being mechanized by a pair of coaxial pivot shafts respectively journalled between the opposed end walls of said drawer and the respectively adjacent one of said opposed side walls of said case, said at least one pair of pivot axes being substantially displaced from a centroid of said opposed end walls of said rectangular parallelopiped forming said drawer;

means for limiting said pivoting of each of said drawers to an arc between a first or closed position, whereat said open top of each drawer forms an imaginary plane oriented to be downwardly sloping toward said rear wall of said case, and a second or open position, whereat each said imaginary plane is sloping generally downwardly toward said substantially open front of said case, said slopes of said imaginary planes associated with the open tops of the respective drawers, when in said second positions, being at respectively differing angles each sufficient to provide clear access to and view of the contents of each drawer from a single vantage position and elevation of a user in front of said case; and means for coupling the pivoting motions of said drawers such that all drawers may be concurrently pivoted from their respective closed positions to their respective open positions, and vice versa, by manually pivoting any one of the drawers between said positions.

2. The lateral file construction of claim 1, wherein said means for coupling the pivoting motions of said drawers comprises a plurality of link elements respectively pivotally coupled between at least one end wall of a drawer and the corresponding end wall of the next vertically adjacent drawer.

3. A lateral file construction comprising:

a stationary case having a bottom wall, a top wall, a rear wall, a pair of opposed side walls, and a substantially open front, said case further forming a generally rectangular parallelopiped having a height, a width from side wall to side wall, and a depth from front to rear;

a plurality of drawers, each in the form of an elongated rectangular parallelopiped having an open top, a pair of opposed end walls, a bottom wall, a front wall, and a rear wall, each of said drawers further having a height, a length, and a depth;

means for pivotally supporting each of said drawers between each of said opposed end walls and the respectively adjacent opposed side walls of said case such that said plurality of drawers are disposed in a generally vertical spaced array, the length of each drawer extending within the width of the case, at least one of said means for pivotally supporting said drawers being mechanized by a pair of coaxial pivot shafts respectively journalled between the opposed end walls of said drawer and the respectively adjacent one of said opposed side walls of said case, said at least one pair of pivot axes being substantially displaced from a centroid of said opposed end walls of said rectangular parallelopiped forming said drawer;

means for limiting said pivoting of each of said drawers to an arc between a first or closed position, whereat said open top of each drawer forms an imaginary plane oriented to be downwardly sloping toward said rear wall of said case, and a second or open position, whereat each said imaginary plane is sloping generally downwardly toward said substantially open front of said case, said slopes of said imaginary planes associated with the open tops of the drawers, when in said second positions, being sufficient to provide clear access to and view of the contents of each drawer from a single vantage position and elevation of a user in front of said case; and a plurality of link elements respectively pivotally coupled between at least one end wall of a drawer and the corresponding end wall of the next vertically adjacent drawer, said link elements being generally of differing lengths pivotally coupled to the respective end walls of the drawers at axes displaced from the geometric centroids of said end walls of said rectangular parallelopipeds forming said drawers, whereby, in said second positions of each drawer, the open top imaginary planes of the several drawers concurrently assume respectively differing angles of slope with respect to the front of the case.

4. The lateral file construction of claim 3, wherein said means for limiting said pivoting of each of said drawers in said first or closed position comprises flanges affixed to said front walls of said drawers so as to extend upwardly therefrom to engagably contact the front surface of the drawer immediately thereabove, with the flange of the uppermost drawer engagably contacting a flange extending along the width of an inner surface of said top wall of said case, said drawers thereby being substantially fully enclosed by said case and the front walls of said drawers.

* * * * *